US011602160B2

(12) United States Patent
Nagai et al.

(10) Patent No.: US 11,602,160 B2
(45) Date of Patent: Mar. 14, 2023

(54) FILLER FOR SMOKING ARTICLE

(71) Applicant: JAPAN TOBACCO INC., Tokyo (JP)

(72) Inventors: Riho Nagai, Yokohama (JP); Yasunobu Inoue, Yokohama (JP); Hideki Nagae, Yokohama (JP); Masanari Makino, Yokohama (JP)

(73) Assignee: JAPAN TOBACCO INC., Tokyo (JP)

( * ) Notice: Subject to any disclaimer, the term of this patent is extended or adjusted under 35 U.S.C. 154(b) by 332 days.

(21) Appl. No.: 16/893,159

(22) Filed: Jun. 4, 2020

(65) Prior Publication Data

US 2020/0297027 A1 Sep. 24, 2020

Related U.S. Application Data

(63) Continuation of application No. PCT/JP2018/038259, filed on Oct. 15, 2018.

(30) Foreign Application Priority Data

Dec. 5, 2017 (JP) ..... JP2017-233351

(51) Int. Cl.
*A24B 15/42* (2006.01)
*A24D 1/00* (2020.01)

(52) U.S. Cl.
CPC ..... *A24B 15/42* (2013.01); *A24D 1/002* (2013.01)

(58) Field of Classification Search
None
See application file for complete search history.

(56) References Cited

U.S. PATENT DOCUMENTS 4,564,031 A 1/1986 Egri
5,829,453 A 11/1998 White et al.
6,325,859 B1 * 12/2001 De Roos ..... A23L 27/72 426/294

(Continued)

FOREIGN PATENT DOCUMENTS

CN 105601983 A 5/2016
EP 0 419 975 A2 4/1991

(Continued)

OTHER PUBLICATIONS

Extended European Search Report for European Application No. 18885546.4 dated Jul. 21, 2021.

(Continued)

*Primary Examiner* — Dennis R Cordray
(74) *Attorney, Agent, or Firm* — Birch, Stewart, Kolasch & Birch, LLP

(57) ABSTRACT

The purpose of the present invention is to provide a filler for a smoking article, a smoking article comprising the filler for a smoking article, and a method for manufacturing the filler for a smoking article. In one embodiment, the filler according to the present invention for a smoking article, said filler comprising a gel which contains a gelling agent and one or more gelation promoters, is characterized by having a tap density of 0.05 g/cm$^3$ or less and a degree of suitability to compression filling of more than 60. In one embodiment, the filler according to the present invention for a smoking article is characterized by comprising a gel which contains pectin having an esterification degree of 12% or less and one or more gelation promoters.

20 Claims, 12 Drawing Sheets

| | | | Example 1-1 | | Example 1-2 | | Example 1-3 | | Example 1-4 | | Example 1-5 | |
|---|---|---|---|---|---|---|---|---|---|---|---|---|
| | Gelling agent | g | LM-pectin | 5.3 | Gellan gum | 5.3 | Na alginate | 5.3 | HM-pectin | 5.3 | Gum arabic | 5.3 |
| | Gelation promotor (1) | g | CaCO3 | 1.3 | CaCO3 | 1.3 | CaCO3 | 1.3 | CaCO3 | 1.3 | CaCO3 | 1.3 |
| | Gelation promotor (2) | ml | Citric acid | 5 | Citric acid | 5 | Citric acid | 5 | Citric acid | 5 | Citric acid | 5 |
| | Others | | | | – | | – | | (DE=70) | | – | |
| | Solid-to-liquid ratio | % | 1.3 | | 1.3 | | 1.3 | | 1.3 | | 1.3 | |
| | Tobacco content ratio | % | – | | – | | – | | – | | | |
| | Manufacturing method | | Freeze drying | | Freeze drying | | Freeze drying | | Freeze drying | | Freeze drying | |
| Evaluation of physical properties | Degree of adaptability to compression filling | % | 74.9 | | 77.8 | | 65.0 | | 77.3 | | 68.6 | |
| | Tap density | g/cc | 0.010 | | 0.011 | | 0.017 | | 0.012 | | 0.047 | |
| | Compressed density | g/cc | 0.039 | | 0.050 | | 0.049 | | 0.053 | | 0.150 | |

| | | | Comparative Example 1-1 | | Comparative Example 1-2 | | Comparative Example 1-3 | | Comparative Example 1-4 | |
|---|---|---|---|---|---|---|---|---|---|---|
| | Gelling agent | g | Starch | 5.3 | CMC | 5.3 | Agar | 5.3 | HM-pectin (with sucrose) | 5.3 |
| | Gelation promotor (1) | g | CaCO3 | 1.3 | CaCO3 | 1.3 | CaCO3 | 1.3 | Sucrose | 21 |
| | Gelation promotor (2) | ml | Citric acid | 5 | Citric acid | 5 | Citric acid | 5 | Citric acid | 5 |
| | Others | | – | | – | | – | | | |
| | Solid-to-liquid ratio | % | 1.3 | | 1.3 | | 1.3 | | 5.3 | |
| | Tobacco content ratio | % | | | | | | | | |
| | Manufacturing method | | Freeze drying | | Freeze drying | | Freeze drying | | Freeze drying | |
| | Degree of adaptability to compression filling | % | 32.5 | | 43.0 | | 44.9 | | 61.0 | |
| | Tap density | g/cc | 0.073 | | 0.142 | | 0.067 | | 0.160 | |
| | Compressed density | g/cc | 0.108 | | 0.250 | | 0.121 | | 0.410 | |

(56) References Cited

U.S. PATENT DOCUMENTS

| | | | | |
|---|---|---|---|---|
| 10,123,560 | B2 | 11/2018 | Rasouli et al. | |
| 2004/0191366 | A1* | 9/2004 | Mangos | A23G 4/20 426/89 |
| 2011/0088708 | A1 | 4/2011 | John et al. | |
| 2015/0114405 | A1 | 4/2015 | Rasouli et al. | |
| 2016/0219926 | A1 | 8/2016 | Whiffen | |

FOREIGN PATENT DOCUMENTS

| | | | |
|---|---|---|---|
| JP | 64-27461 | A | 1/1989 |
| JP | 3-180166 | A | 8/1991 |
| JP | 8-332068 | A | 12/1996 |
| JP | 2001-507925 | A | 6/2001 |
| JP | 2015-515857 | A | 6/2015 |
| JP | 2016-523556 | A | 8/2016 |
| KR | 10-1984-0004864 | A | 10/1984 |
| KR | 10-2015-0009960 | A | 1/2015 |
| WO | WO 98/15191 | A1 | 4/1998 |

OTHER PUBLICATIONS

International Search Report, issued in PCT/JP2018/038259, dated Nov. 27, 2018.

Chen et al., "Principles of Food Chemistry", South China University of Technology Press, Feb. 2015, pp. 123-125 (6 pages total), with partial English translation.

Chinese Office Action and Search Report for Chinese Application No. 201880078919.9, dated Sep. 3, 2021, with English translation of the Chinese Office Action.

Korean Office Action for Korean Application No. 10-2020-7015202, dated Dec. 17, 2021, with English translation.

Wu, "Ultrafine Powder Engineering Basis", China Building Materials Industry Press, Sep. 2016, pp. 24-25 (5 pages total), with partial English translation.

* cited by examiner

Fig. 1

| | | | Example 1-1 | | Example 1-2 | | Example 1-3 | | Example 1-4 | | Example 1-5 | |
|---|---|---|---|---|---|---|---|---|---|---|---|---|
| | Gelling agent | g | LM-pectin | 5.3 | Gellan gum | 5.3 | Na alginate | 5.3 | HM-pectin | 5.3 | Gum arabic | 5.3 |
| | Gelation promotor (1) | g | CaCO3 | 1.3 | CaCO3 | 1.3 | CaCO3 | 1.3 | CaCO3 | 1.3 | CaCO3 | 1.3 |
| | Gelation promotor (2) | ml | Citric acid | 5 | Citric acid | 5 | Citric acid | 5 | Citric acid | 5 | Citric acid | 5 |
| | Others | | | | – | | – | | (DE=70) | | – | |
| | Solid-to-liquid ratio | % | 1.3 | | 1.3 | | 1.3 | | 1.3 | | 1.3 | |
| | Tobacco content ratio | % | – | | – | | – | | – | | | |
| | Manufacturing method | | Freeze drying | | Freeze drying | | Freeze drying | | Freeze drying | | Freeze drying | |
| Evaluation of physical properties | Degree of adaptability to compression filling | % | 74.9 | | 77.8 | | 65.0 | | 77.3 | | 68.6 | |
| | Tap density | g/cc | 0.010 | | 0.011 | | 0.017 | | 0.012 | | 0.047 | |
| | Compressed density | g/cc | 0.039 | | 0.050 | | 0.049 | | 0.053 | | 0.150 | |

| | | Comparative Example 1-1 | | Comparative Example 1-2 | | Comparative Example 1-3 | | Comparative Example 1-4 | |
|---|---|---|---|---|---|---|---|---|---|
| Gelling agent | g | Starch | 5.3 | CMC | 5.3 | Agar | 5.3 | HM-pectin (with sucrose) | 5.3 |
| Gelation promotor (1) | g | CaCO3 | 1.3 | CaCO3 | 1.3 | CaCO3 | 1.3 | Sucrose | 21 |
| Gelation promotor (2) | ml | Citric acid | 5 | Citric acid | 5 | Citric acid | 5 | Citric acid | 5 |
| Others | | – | | – | | – | | | |
| Solid-to-liquid ratio | % | 1.3 | | 1.3 | | 1.3 | | 5.3 | |
| Tobacco content ratio | % | | | | | | | | |
| Manufacturing method | | Freeze drying | | Freeze drying | | Freeze drying | | Freeze drying | |
| Degree of adaptability to compression filling | % | 32.5 | | 43.0 | | 44.9 | | 61.0 | |
| Tap density | g/cc | 0.073 | | 0.142 | | 0.067 | | 0.160 | |
| Compressed density | g/cc | 0.108 | | 0.250 | | 0.121 | | 0.410 | |

Fig. 4

| | | | Example 2-1 | | Example 2-2 | | Example 2-3 | | Example 2-4 | | Comparative Example 2-1 | |
|---|---|---|---|---|---|---|---|---|---|---|---|---|
| | Gelling agent | g | LM-pectin | 6.5 | LM-pectin | 6.5 | LM-pectin | 6.5 | LM-pectin | 6.5 | LM-pectin | 6.5 |
| | Gelation promotor (1) | g | $CaCO_3$ | 3.5 | $CaCO_3$ | 3.5 | $CaCO_3$ | 3.5 | $CaCO_3$ | 3.5 | $CaCO_3$ | 3.5 |
| | Gelation promotor (2) | ml | Citric acid | 5 | Citric acid | 5 | Citric acid | 5 | Citric acid | 5 | Citric acid | 5 |
| | Others | | Tobacco fine powder | 0.1 | Tobacco fine powder | 1.1 | Tobacco fine powder | 2.5 | Tobacco fine powder | 5.4 | Tobacco fine powder | 10 |
| | Solid-to-liquid ratio | % | 2.0 | | 2.2 | | 2.5 | | 3.1 | | 4.0 | |
| | Tobacco content ratio | % | 1.0 | | 10.0 | | 20.0 | | 35.0 | | 50.0 | |
| | Manufacturing method | | Freeze drying | | Freeze drying | | Freeze drying | | Freeze drying | | Freeze drying | |
| Evaluation of physical properties | Degree of adaptability to compression filling | % | 78.3 | | 77.4 | | 73.2 | | 60.7 | | 51.9 | |
| | Tap density | g/cc | 0.012 | | 0.011 | | 0.014 | | 0.021 | | 0.029 | |
| | Compressed density | g/cc | 0.054 | | 0.051 | | 0.051 | | 0.052 | | 0.060 | |

Fig. 5

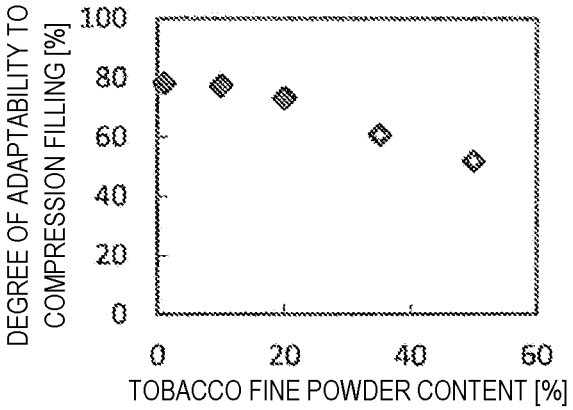

Fig. 6

| | | Comparative Example 3-1 | | Comparative Example 3-2 | | Comparative Example 3-3 | |
|---|---|---|---|---|---|---|---|
| Gelling agent | g | LM-pectin | 5.3 | Gellan gum | 5.3 | Na alginate | 5.3 |
| Gelation promotor (1) | g | CaCO3 | 1.3 | CaCO3 | 1.3 | CaCO3 | 1.3 |
| Gelation promotor (2) | ml | Citric acid | 5 | Citric acid | 5 | Citric acid | 5 |
| Others | | | | | | | |
| Solid-to-liquid ratio | % | 1.3 | | 1.3 | | 1.3 | |
| Manufacturing method | | Hot-air drying | | Hot-air drying | | Hot-air drying | |
| Degree of adaptability to compression filling | % | 3.0 | | −2.8 | | −15.7 | |
| Tap density | g/cc | 0.250 | | 0.263 | | 0.255 | |
| Compressed density | g/cc | 0.258 | | 0.256 | | 0.220 | |

Fig. 7

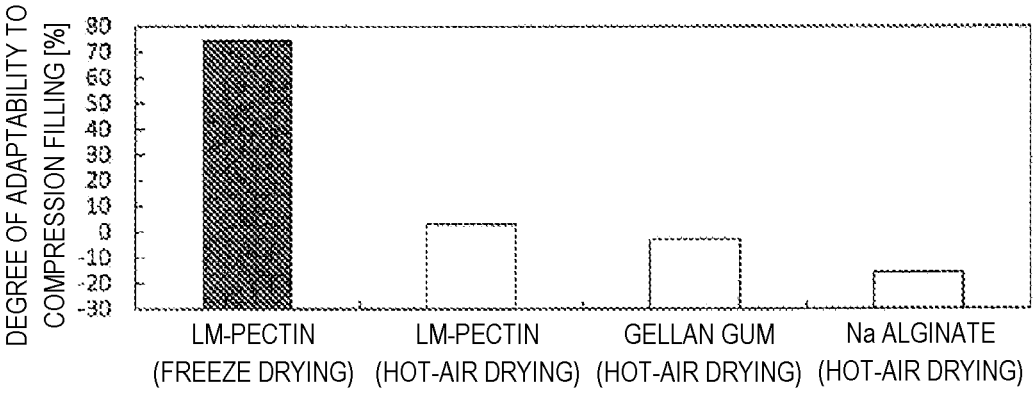

Fig. 8

| | | Example 4-1 | | Comparative Example 4-1 | | Comparative Example 4-2 | | Comparative Example 4-3 | | Comparative Example 4-4 | |
|---|---|---|---|---|---|---|---|---|---|---|---|
| Gelling agent | g | LM-pectin | 12 | LM-pectin | 18 | LM-pectin | 26.8 | LM-pectin | 40 | LM-pectin | 50 |
| Gelation promotor (1) | g | $CaCO_3$ | 2.9 | $CaCO_3$ | 4.4 | $CaCO_3$ | 6.574 | $CaCO_3$ | 9.9 | $CaCO_3$ | 12.26 |
| Gelation promotor (2) | ml | Citric acid | 5 | Citric acid | 5 | Citric acid | 5 | Citric acid | 5 | Citric acid | 5 |
| Others | | | | | | | | | | | |
| Solid-to-liquid ratio | % | 3.0 | | 4.5 | | 6.7 | | 10.0 | | 12.5 | |
| Manufacturing method | | Freeze drying | | Freeze drying | | Freeze drying | | Freeze drying | | Freeze drying | |
| Degree of adaptability to compression filling | % | 62.3 | | 37.7 | | 20.0 | | 15.6 | | 0.0 | |
| Tap density | g/cc | 0.017 | | 0.028 | | 0.038 | | 0.041 | | 0.054 | |
| Compressed density | g/cc | 0.044 | | 0.044 | | 0.048 | | 0.049 | | 0.054 | |

Fig. 11

| | | Example 5-1 | | Example 5-2 | | Example 5-3 | | Example 5-4 | | Comparative Example 5-1 | |
|---|---|---|---|---|---|---|---|---|---|---|---|
| Gelling agent | g | LM-pectin | 5.9 | LM-pectin | 4.6 | LM-pectin | 3.3 | LM-pectin | 2 | LM-pectin | 0.7 |
| Gelation promotor (1) | g | CaCO3 | 0.7 | CaCO3 | 2 | CaCO3 | 3.3 | CaCO3 | 4.6 | CaCO3 | 5.9 |
| Gelation promotor (2) | ml | Citric acid | 5 | Citric acid | 5 | Citric acid | 5 | Citric acid | 5 | Citric acid | 5 |
| Others | | | | | | | | | | | |
| Solid-to-liquid ratio | % | 1.3 | | 1.3 | | 1.3 | | 1.3 | | 1.3 | |
| $CaCO_3$ mixing ratio | % | 10.6 | | 30.3 | | 50.0 | | 69.7 | | 89.4 | |
| | | 1:0. 12 | | 1:0. 43 | | 1:1 | | 1:2. 3 | | 1:8. 42 | |
| Manufacturing method | | Freeze drying | | Freeze drying | | Freeze drying | | Freeze drying | | Freeze drying | |
| Degree of adaptability to compression filling | % | 79.5 | | 83.1 | | 79.9 | | 63.1 | | 52.8 | |
| Tap density | g/cc | 0.009 | | 0.009 | | 0.011 | | 0.031 | | 0.067 | |
| Compressed density | g/cc | 0.046 | | 0.052 | | 0.054 | | 0.085 | | 0.142 | |
| Expansion property | cc/g | 21.739 | | 19.411 | | 18.396 | | 11.742 | | 7.019 | |

Fig. 15

| | | Example 6-1 | |
|---|---|---|---|
| Gelling agent | g | LM-pectin | 5.3 |
| Gelation promotor (1) | g | $CaCO_3$ | 1.3 |
| Gelation promotor (2) | ml | Citric acid | 5 |
| Others | | | |
| Solid-to-liquid ratio | | 1.3 | |
| | | | |
| Manufacturing method | | Freeze drying * air cooling | |
| Degree of adaptability to compression filling | % | 62.5 | |
| Tap density | | 0.015 | |
| Compressed density | | 0.040 | |
| Expansion property | cc/g | 25.000 | |

Fig. 16

| | | Example 7-1 | | Example 7-2 | | Comparative Example 7-1 | | Comparative Example 7-2 | | Comparative Example 7-3 | | Comparative Example 7-4 | | Comparative Example 7-5 | | Comparative Example 7-6 | |
|---|---|---|---|---|---|---|---|---|---|---|---|---|---|---|---|---|---|
| Gelling agent | g | LM-pectin | 5.3 | LM-pectin | 5.3 | LM-pectin | 5.3 | LM-pectin | 5.3 | HM-pectin | 5.3 | HM-pectin | 5.3 | Gellan gum | 5.3 | Na alginate | 5.3 |
| Gelation promotor (1) | g | CaCO3 | 1.3 | CaCO3 | 1.3 | CaCO3 | 1.3 | CaCO3 | 1.3 | CaCO3 | 3.5 | CaCO3 | 3.5 | CaCO3 | 3.5 | CaCO3 | 1.3 |
| Gelation promotor (2) | ml | Citric acid | 5 | Citric acid | 5 | Citric acid | 5 | Citric acid | 5 | Citric acid | 5 | Citric acid | 5 | Citric acid | 5 | Citric acid | 5 |
| Others | | Pectin DE=9 | | Pectin DE=12 | | Pectin DE=23 | | Pectin DE=38 | | Pectin DE=58 | | Pectin DE=65 | | | | | |
| High-odor cigarette selectivity | - | 0.07 | | 0.07 | | 0.20 | | 0.17 | | 0.20 | | 0.23 | | 0.27 | | 0.27 | |

FILLER FOR SMOKING ARTICLE

CROSS REFERENCE TO RELATED APPLICATIONS

The present application is a continuation application of International Application No. PCT/JP2018/038259, filed on Oct. 15, 2018, which claims priority under 35 U.S.C. 119(a) to Patent Application No. 2017-233351, filed in Japan on Dec. 5, 2017, all of which are hereby expressly incorporated by reference into the present application.

TECHNICAL FIELD

The present invention relates to a filler for a smoking article, a smoking article including a filler for a smoking article, and a method for manufacturing a filler for a smoking article.

BACKGROUND ART

Filling Materials for Smoking Article

Japanese Translation of PCT International Application No. 2015-515857 describes "a smoking article comprising a tobacco substrate, the tobacco substrate comprising tobacco and having a tobacco density of about 150 mg/cm$^3$ or less and a hardness of 60% or greater" (claim 1). Japanese Translation of PCT International Application No. 2015-515857 also describes "a method comprising: combining tobacco with a gelling agent and a solvent to form a tobacco gel; and removing the solvent from the tobacco gel to form a tobacco substrate wherein the tobacco substrate has a tobacco density of about 150 mg/cm<3> or less and a hardness of 60% or greater" (claim 11). It is stated that the smoking article described in the literature has an air flow property, firmness, and hardness, which are independent of the amount of the tobacco in the tobacco substrate.

Japanese Patent Laid-Open No. 3-180166 describes a cigarette comprising smokable filler material including an intimate mixture of agglomerated matrix filler having an inorganic component and an organic component, and tobacco agent.

Japanese Patent Laid-Open No. 8-332068 describes an extruded tobacco composition comprising tobacco and gain flour as main components.

Japanese Translation of PCT International Application No. 2016-523556 describes a smokable material for inclusion in a smoking article, the material comprising particles or fragments comprising acacia gum.

Problems of Conventional Smoking Articles

Conventional smoking articles which are light in weight have a possibility of being easily deformed when load is applied. When a smoking article is manufactured industrially, a filler for a smoking article, which is included in a smoking article, deforms, which may become a cause for a top drop or cause a problem that the shape of the smoking article cannot be maintained.

In addition, a product using aerogel has poor restorability and easily deforms when load is applied. Therefore, there are such problems as poor manufacturing suitability like incapability of maintenance of the shape of a smoking article, and poor transportation efficiency due to the fact that the product cannot be compressed.

Further, conventional smoking articles do not have high resistance to an environmental change and specifically deform when the temperature reaches, for example, around 70° C., so that the tap density is significantly lowered, and as a result, there is a possibility that the hardness is lowered. Furthermore, there is a possibility that the side stream smoke odor and mainstream smoke flavor of conventional smoking articles are malodorous due to a component produced when a filler for a smoking article is heated.

Development of a filler for a smoking article, which is excellent in the aspects of production suitability, durability, low odor, and the like, has been desired.

CITATION LIST

Patent Literature

PTL 1: Japanese Translation of PCT International Application No. 2015-515857

PTL 2: Japanese Patent Laid-Open No. 3-180166

PTL 3: Japanese Patent Laid-Open No. 8-332068

PTL 4: Japanese Translation of PCT International Application No. 2016-523556

SUMMARY OF INVENTION

Technical Problem

The present inventors have found that a filler for a smoking article having a network structure, the filler being light in weight, having restorability, and having a low density, is obtained by drying a wet substance comprising a gel in which a gelling agent and a gelation promotor are bonded to form a crosslinked structure, and have thereby reached the present invention.

Further, it has been ascertained that use of a filler for a smoking article comprising a gel comprising pectin obtained by subjecting a gelling agent to an acid treatment, the pectin having a degree of esterification of 12% or less, makes the side stream smoke odor significantly lower than other gelling fillers.

Solution to Problem

The present invention includes, but not limited to, the following embodiments.

Embodiment 1

A filler for a smoking article, comprising a gel comprising: a gelling agent; and one or more gelation promotors, wherein the filler for a smoking article has a tap density of 0.05 g/cm$^3$ or less and a degree of adaptability to compression filling of more than 60.

Embodiment 2

The filler for a smoking article according to Embodiment 1, wherein the gelling agent is a polysaccharide having a carboxyl group.

Embodiment 3

The filler for a smoking article according to Embodiment 1 or 2, wherein the gelling agent is selected from the group consisting of: pectin; gellan gum or sodium alginate; gum arabic; and xanthan gum or gum tragacanth.

Embodiment 4

The filler for a smoking article according to any one of Embodiments 1 to 3, wherein at least one of the gelation promotors is a compound comprising a divalent cation.

Embodiment 5

The filler for a smoking article according to any one of Embodiments 1 to 4, wherein at least one of the gelation promotors is a compound comprising a calcium ion.

Embodiment 6

The filler for a smoking article according to any one of Embodiments 1 to 5, wherein the gel is dried by freeze drying, supercritical drying, or drying under reduced pressure.

Embodiment 7

The filler for a smoking article according to any one of Embodiments 1 to 6, wherein the gelling agent is pectin having a degree of esterification of 12% or less.

Embodiment 8

The filler for a smoking article according to any one of Embodiments 1 to 7, further comprising more than 0% by weight and 35% by weight or less of tobacco.

Embodiment 9

A filler for a smoking article comprising a gel comprising: pectin having a degree of esterification of 12% or less; and one or more gelation promotors.

Embodiment 10

The filler for a smoking article according to Embodiment 9, wherein at least one of the gelation promotors is a compound comprising a divalent cation.

Embodiment 11

The filler for a smoking article according to Embodiment 1 or 9, wherein the gelling agent is a polysaccharide having a carboxyl group, at least one of the gelation promotors is a compound comprising a divalent cation, and a molar ratio of a monomer comprising a carboxyl group in the polysaccharide to the compound comprising the cation is in a range of 20:1 to 1:10.

Embodiment 12

The filler for a smoking article according to any one of Embodiments 9 to 11, wherein at least one of the gelation promotors is a compound comprising a calcium ion.

Embodiment 13

The filler for a smoking article according to any one of Embodiments 9 to 12, further comprising more than 0% by weight and 35% by weight or less of tobacco.

Embodiment 14

A smoking article comprising the filler for a smoking article according to any one of Embodiments 1 to 13.

Embodiment 15

The smoking article according to Embodiment 14, comprising 10% by weight to 30% by weight of the filler for a smoking article according to any one of Embodiments 1 to 13 in a tobacco rod.

Embodiment 16

A method for manufacturing a filler for a smoking article, the filler comprising a gel comprising: a gelling agent; and one or more gelation promotors, the method comprising a step of drying the gel comprising: a gelling agent; and one or more gelation promotors by freeze drying, supercritical drying, or drying under reduced pressure.

Embodiment 17

The method according to Embodiment 16, further comprising a gelation step of dissolving the gelling agent and the gelation promotors in a solvent, wherein at least one of the gelation promotors is a compound comprising a divalent cation, and a ratio of the gelling agent and the compound comprising a divalent cation to the solvent is 3% or less.

BRIEF DESCRIPTION OF DRAWINGS

FIG. 1 shows the compositions and the results of investigating tap density (after measuring compressed density), compressed density, and a degree of adaptability to compression filling of the fillers for a smoking article of the present invention described in Example 1, and the fillers for a smoking article of Comparative Example 1.

FIG. 4 shows the compositions and the results of investigating tap density (after measuring compressed density), compressed density, and a degree of adaptability to compression filling of the fillers for a smoking article of the present invention described in Example 2, and the filler for a smoking article of Comparative Example 2.

FIG. 5 is a graph with the degree of adaptability to compression filling and the tobacco fine powder content (%) in FIG. 4 as the vertical axis and the horizontal axis, respectively.

FIG. 6 shows the compositions and the results of investigating tap density (after measuring compressed density), compressed density, and a degree of adaptability to compression filling of the fillers for a smoking article of Comparative Example 3.

FIG. 7 is a bar graph showing the degree of adaptability to compression filling of Example 1 and of Comparative Example 3.

FIG. 8 shows the compositions and the results of investigating tap density (after measuring compressed density), compressed density, and a degree of adaptability to compression filling of the filler for a smoking article of the present invention described in Example 4, and the fillers for a smoking article of Comparative Example 4.

FIG. 11 shows the compositions and the results of investigating tap density (after measuring compressed density), compressed density, a degree of adaptability to compression filling, and an expansion property of fillers for a smoking article of the fillers for a smoking article of the present invention described in Example 5.

FIG. 15 shows the compositions and the results of investigating tap density (after measuring compressed density), compressed density, a degree of adaptability to compression filling, and an expansion property of a filler for a smoking article of the filler for smoking article of the present invention described in Example 6-1.

FIG. 16 shows the compositions and the high-odor cigarette selectivity of cigarettes of the present invention of Example 7 and cigarettes of Comparative Example.

DESCRIPTION OF EMBODIMENTS

Figure 2:
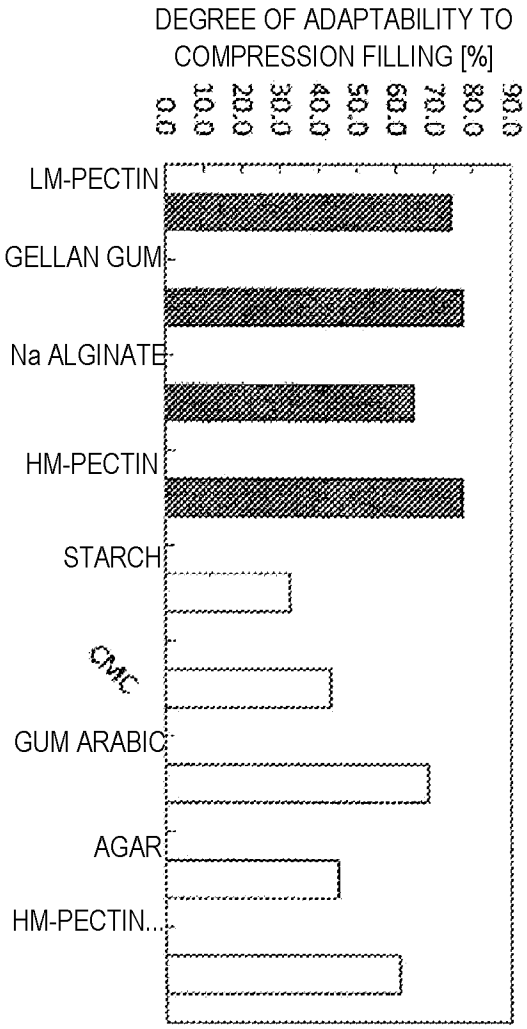
FIG. 2 is a bar graph of the degree of adaptability to compression filling in FIG. 1.

The present invention relates to a filler for a smoking article, use of the same, and a method for manufacturing the same.

1. Filler a for Smoking Article

The present invention relates to a filler for a smoking article.

The filler for a smoking article of the present invention comprises a gel comprising: a gelling agent; and one or more gelation promotors, and has a tap density (after measuring compressed density) of 0.05 $g/cm^3$ or less and a degree of adaptability to compression filling of more than 60.

(1) Gelling Agent

The "gelling agent" is a chemical substance that causes gelation to a liquid to solidify the liquid. As the gelling agent, polysaccharides, such as pectin, gellan gum, sodium alginate, gum arabic, xanthan gum, gum tragacanth, guar gum, and carrageenan, and the like are known.

In the present invention, the gelling agent is preferably a polysaccharide. The gelling agent is more preferably a polysaccharide having a carboxyl group. The polysaccharide having a carboxyl group easily forms a gel particularly in the presence of a divalent cation, and carboxyl groups and the cation make a junction zone to form a gel. When junction zones exist in a gel, the filler for a smoking article comprising the gel takes a network structure. The network structure makes a feel of the filler for a smoking article fluffy and smooth. In the present invention, the gelling agent is preferably pectin, gellan gum, sodium alginate, gum arabic, xanthan gum or gum tragacanth.

"Pectin" is a polysaccharide in which galacturonic acid and galacturonic acid methyl ester are constituent units and are α-1,4-bonded. It is known that some various saccharides are contained besides galacturonic acid. Pectin is generally classified into LM-pectin which has a degree of esterification of less than 50%, and HM-pectin which has a degree of esterification of 50% or more.

Pectin forms a gel particularly in the presence of a divalent cation, such as a calcium ion, and carboxyl groups of galacturonic acid in pectin and the cation make a junction zone to form a gel. The gelation property is stronger in pectin having a larger number of junction zones, that is, having a lower degree of esterification.

In one embodiment of the present invention, the gelling agent is LM-pectin. In one embodiment of the present invention, the gelling agent is pectin having a degree of esterification of 12% or less.

"Gellan gum" is known as a water-soluble polysaccharide synthesized by *Pseudomonas elodea*, which is a kind of eubacteria. When a cation is added into an aqueous solution, the water-solubility of gellan gum is lowered due to electric neutralization to form a gel. Gellan gum is a polymeric compound in which repeating units each consisting of four saccharides of two D-glucose residues, one L-rhamnose residue, and one D-glucuronic acid are linearly connected. The repeating structure of the four saccharides is as follows.

$$[D\text{-}Glc(\beta1\rightarrow4)D\text{-}\mathrm{GlcA}(\beta1\rightarrow4)D\text{-}Glc(\beta1\rightarrow4)L\text{-}Rha(\alpha1\rightarrow3)]n$$

"Sodium alginate" is a kind of polysaccharides contained mainly in brown algae. Sodium alginate has a structure in which α-L-guluronic acid and β-D-mannuronic acid are bonded through 1,4-glycoxide bond in a pyranose type (CAS 9005-38-3). Sodium alginate has a characteristic that it forms a gel when a cation is added.

"Gum arabic" is also called "arabic gum" or "arabic resin" and is obtained by drying a secretion from a cut of bark of Acacia senegal or its congenic, allied species. Gum arabic contains a polysaccharide (polyuronic acid) as the main component and is a mixture of arabinogalactan (75 to 94%), arabinogalactan-protein (5 to 20%), and a glycoprotein (1 to 5%). The structure of the polysaccharide has galactose in the main chain and galactose, arabinose, rhamnose, and glucuronic acid in the side chains. Gum arabic is different from hemicellulose forming a cell wall in that carboxyl groups are free, and gum arabic is usually in the form of a calcium salt.

"Xanthan gum" is a kind of polysaccharides and is generally manufactured by fermenting a starch of corn sugar by bacteria. Xanthan gum has a repeating structure whose unit consists of two glucose molecules, two mannose molecules, and a glucuronic acid molecule (CAS 11138-66-2).

"Gum tragacanth" is a thickening polysaccharide obtained by drying a secretion of tragacanth, which is a leguminous plant, and is a complicated mixture of polysaccharides, the mixture composed of arabinose, xylose, fucose, galactose, galacturonic acid, and the like. Gum tragacanth contains, as the main components, two types of polysaccharides, the one is acidic and the other is neutral, and contains starch, cellulose, inorganic matter, and the like.

(2) Gelation Promotor

The gel contained in the filler for a smoking article of the present invention comprises one or more gelation promotors. The gelation promotor is a chemical substance having an action that promotes gelation of the gelling agent. As the gelation promotor, for example, a solution of a halogen acid salt (such as a chloride), citric acid, a carbonate, a sulfate, a phosphate, or the like of calcium, magnesium, sodium, potassium, lithium, silver, zinc, copper, gold, aluminum, or the like, or a solution of a cationic polymer is used. For example, calcium carbonate, calcium chloride, calcium lactate, ammonium chloride, potassium chloride, sodium chloride, potassium citrate, sodium citrate, magnesium sulfate, or potassium phosphate can be used.

In one embodiment of the present invention, at least one of the gelation promotors is a compound comprising a divalent cation. Examples of the divalent cation include a calcium ion and a magnesium ion. Preferably, at least one of the gelation promotors is a compound comprising a calcium ion (for example, calcium carbonate, calcium chloride, calcium lactate, calcium citrate, or calcium acetate). The "gelation promotor" in the present specification means only a compound comprising a divalent cation in some cases.

In one embodiment of the present invention, examples of the gelation promotor used in combination with the compound comprising a divalent cation include food additives which are acidulants, such as citric acid, acetic acid, succinic acid, gluconic acid, adipic acid, lactic acid, malic acid, tartaric acid, fumaric acid, and phosphoric acid. In one embodiment of the present invention, the gelation promotor is a combination of the compound comprising a calcium ion (for example, calcium carbonate) and citric acid.

In the filler for a smoking article of the present invention, the polysaccharide that constitutes the gelling agent easily forms a gel in the presence of a divalent cation, and carboxyl groups and the cation make a junction zone to form a gel. When junction zones exist in a gel, the filler for a smoking article, comprising the gel, takes a network structure. For efficiently causing gelation to carboxyl groups and the compound comprising a divalent cation, the compound being a gelation promotor, thereby obtaining the filler for a smoking article, the two desirably exist in a ratio of the number of the two of 2:1. This corresponds to a case where the molar ratio of a monomer comprising a carboxyl group in the polysaccharide to the cation is 2:1. The molar ratio of the monomer comprising a carboxyl group in the polysaccharide to the cation is preferably, but not limited to, in a range of 20:1 to 1:10, 10:1 to 1:5, 5:1 to 1:2.5, 3:1 to 1:1.5, 2.5:1 to 1:1.25, or 2.2:1 to 1:1.1.

Accordingly, in the filler for a smoking article in one embodiment of the present invention, the gelling agent is a polysaccharide having a carboxyl group, at least one of the gelation promotors is a compound comprising a divalent cation, and the molar ratio of the monomer comprising a carboxyl group in the polysaccharide to the compound comprising the cation is in a range of 20:1 to 1:10.

It was ascertained that Example 5-1 to Example 5-4 of the present application satisfy the requirements that the tap density is 0.05 g/cm$^3$ or less and the degree of adaptability to compression filling is more than 60 in a range where the weight ratio of the gelling agent (pectin) to the gelation promotor (calcium carbonate) is 1:0.12 to 1:2.3. This corresponds to a case where the molar ratio of the monomer comprising a carboxyl group in pectin to the divalent cation which is a gelation promotor is 1:0.25 to 1:5 (4.9).

In one embodiment of the present invention, the weight ratio of pectin to calcium carbonate which is a compound comprising a divalent cation is preferably in a range of 1:0.01 to 1:5, in a range of 1:0.05 to 1:3, in a range of 1:0.10 to 1:2.5, or in a range of 1:0.12 to 1:1.5 in the filler for a smoking article of the present invention. This means that the molar ratio of the monomer comprising a carboxyl group in pectin to a divalent cation which is a gelation promotor is preferably in a range of 1:0.02 to 1:11, in a range of 1:0.1 to 1:6.3, in a range of 1:0.2 to 1:5.3, or in a range of 1:0.25 to 1:3.2.

(3) Tap Density is 0.05 g/cm$^3$ or Less

The filler for a smoking article of the present invention has a tap density (after measuring compressed density) of 0.05 g/cm$^3$ or less. The tap density is preferably 0.04 g/cm$^3$ or less, 0.03 g/cm$^3$ or less, 0.02 g/cm$^3$ or less, or 0.01 g/cm$^3$ or less. The tap density is more preferably 0.02 g/cm$^3$ or less, or 0.01 g/cm$^3$ or less.

Bulk density is a density measured when a powder is packed into a container, and the empty spaces in the container are also regarded as a volume. The "tap density" refers to bulk density measured in such a way as to tap a powder sample when packed into a container, thereby packing the sample in a larger amount. After the initial volume is measured, a measuring cylinder or container for measurement is tapped mechanically, and the volume is read until a change in volume is hardly recognized.

The tap density of the filler for a smoking article of the present invention can be measured as follows using, for example, "Test methods for bulk density of fine ceramic powder" (JIS 1628-1997) in Japanese Industrial Standards as reference.

A filler for a smoking article in a weight of 3.0 g is placed in a 250 cm$^3$ measuring cylinder, subsequently the container is installed on a tap denser set in such a way that the tap height is 10 mm, and the tap speed is 100 times/minute, and 600 times of taps are performed to measure the height to the sample surface. Further, 100 times of taps are added to measure the height to the sample surface. On this occasion, whether the difference from the previously measured height to the sample surface is within 1 mm is checked. When the difference exceeds 1 mm, 100 times of taps at a time are repeated until the difference from the previously measured height falls within 1 mm.

A plurality of times of measurement is desirably performed to determine an arithmetical mean as the measurement result. In Examples of the present specification, the measurement was performed three times to determine an arithmetical mean as the measurement result (g/cm$^3$).

It is important to perform the taps until a change in volume is hardly recognized and to calculate the density using the finally measured volume and mass. The tap speed, the number of times of taps, the amount of the filler for a smoking article to be used, the size of the measuring cylinder, and the like can appropriately be changed.

In Examples of the present specification, the tap density was measured after measuring the compressed density. The "tap density" means a tap density after measuring the compressed density, that is, after applying load, such as compression, to the filler for a smoking article unless otherwise stated in the present specification.

(4) Degree of Adaptability to Compression Filling is More than 60

The filler for a smoking article of the present invention has a degree of adaptability to compression filling of more than 60. The filler for a smoking article preferably has a degree of adaptability to compression filling of 65 or more, more preferably 70 or more.

Compressed Density

Compressed density means a density of a substance after applying a certain pressure load to the substance. The compressed density can be measured using, for example, an expansion property measuring apparatus (for example, Densimeter DD60A, manufactured by Borgwaldt KC GmbH). The compressed density can also be measured in such a way that an arbitrary weight of the filler for a smoking article is weighed and placed in a container having a certain cross-sectional area and a certain cross-sectional shape, and the volume of the sample is calculated from the sample height obtained after a certain load is applied vertically to the upper surface of the sample.

In Examples of the present specification, a filler for a smoking article in a weight of 3.0 g was placed in a tobacco container having a diameter of 60 mm, and the sample height at the time when a load of 2 kg was applied thereto was read with an expansion property measuring apparatus and was converted to volume to determine the compressed density ($g/cm^3$). To obtain the compressed density for calculating the degree of adaptability to compression filling, the compressed density can be obtained by applying compression load equivalent to the compression load in Examples of the present invention even if the compression load is not applied under the completely same condition in Examples of the present invention.

A plurality of times of measurement is desirably performed to determine an arithmetical mean as the measurement result. In Examples of the present specification, the measurement was performed three times to determine an arithmetical mean as the measurement result.

Degree of Adaptability to Compression Filling

The degree of adaptability to compression filling is defined and calculated as follows.

Degree of adaptability to compression filling=(Compressed density−Tap density after compression measurement)/Compressed density×100

The tap density used for calculating the degree of adaptability to compression filling is the tap density after compression measurement, that is, the tap density of a filling material to which load is applied once.

The more easily a filler breaks, the lower the value of the degree of adaptability to compression filling is. This is because when a filler is broken (such as being crushed or pulverized) due to the load for measuring the compressed density, the filler shows a value which is close to the compressed density (density is high) at the time when the tap density is measured after the filler is broken. Also, the harder a filler is to compress, the lower the degree of adaptability to compression filling is. This is because the filler is hard to compress, and therefore the compressed density and the tap density after compression take a value close to each other. Conversely, the value of the degree of adaptability to compression filling of a filler which is easy to compress but returns back to the original state after compression is high.

The load used in the measurement of the compressed density of the fillers for a smoking article of Examples of the present specification is the load which is applied when an expansion property is measured in the tobacco field. This load has a value which is close to the rolling-up pressure at the time when a tobacco rod is rolled up. Therefore, a filler for a smoking article such that it is broken by this load is broken when it is rolled up, which causes top drop, and is not preferable in terms of maintaining the shape of the tobacco rod. On the other hand, with respect to a filler which is hard to compress, the transportation efficiency at the time when the filler itself is transported is poor. Cut tobacco, when transported, is usually transported in such a way as to be compressed to such an extent that the cut tobacco is not crushed. Similarly, a filler for a smoking article is also transported in such a way to be compressed to such an extent that the filler for a smoking article is not crushed, but when this compression at the time of transportation cannot sufficiently be performed, the transportation efficiency is poor. In addition, being hard to compress means being unlikely to deform, and therefore there is a risk that a tear of roll paper and distortion of a rod shape are brought about due to the rolling-up pressure.

The filler for a smoking article preferably has a higher degree of adaptability to compression filling when compression with a certain load (about the same load as the load at the time when an expansion property is measured) is applied thereto.

Expansion Property

The expansion property refers to a numerical value of the volume of 1 g of a filler for a smoking article determined when the filler for a smoking article is compressed by a certain pressure for a certain time. In other words, when the expansion property of a filler for a smoking article is high, a lot of smoking articles per weight of the filler for a smoking article can be made. In addition, by measuring the expansion property, the quantity of the smoking articles which can be manufactured from a certain amount of the raw material can be estimated. Therefore, measuring the expansion property is useful in manufacturing planning, and further, enables selection and use of a raw material which makes manufacturing costs low when breed development and leaf fillings design are performed. Accordingly, the expansion property of a filler for a smoking article is an important factor from the viewpoint of raw material costs and product design.

In Examples of the present specification, the fillers for a smoking article of the present invention exhibited a high expansion property, as high as 10 $cm^3/g$ or more.

(5) Method of Drying Gel

The gel contained in the filler for a smoking article of the present invention is preferably dried by freeze drying, supercritical drying, or drying under reduced pressure.

"Freeze drying" is a technique of rapidly freezing a substance comprising moisture, and further, reducing pressure to sublimate the moisture in a vacuum state, thereby drying the substance. Freeze drying has a characteristic that the temperature does not need to be elevated for drying, which does not cause deterioration of components to occur. Freeze drying is also referred to as freeze dry or refrigeration drying.

"Super critical drying" is a drying technique using a supercritical fluid. The supercritical fluid is a state of a substance placed under temperature/pressure equal to or higher than those of the critical point. The supercritical fluid has high diffusibility and solubility, and surface tension does not act on the supercritical fluid. By utilizing these characteristics, supercritical drying enables drying of even a minute substance, in which significant contraction or structural destruction would occur in other drying methods, while keeping the structure as it is.

"Drying under reduced pressure" is a method of performing drying under reduced pressure. When the atmospheric pressure is lowered, the water vapor pressure in the air is lowered, so that: drying can be performed at a relatively low temperature, which can suppress deterioration of components; and the boiling point of moisture is lowered to accelerate the evaporation speed, which can make drying of an object faster.

The present invention is a filler for a smoking article satisfying the requirements that the tap density is 0.05 $g/cm^3$ or less and the degree of adaptability to compression filling is more than 60. By appropriately selecting the types or amounts of the gelling agent and the gelation promotor or/and the method of drying the gel, the filler for a smoking article of the present invention can be obtained. The filler for a smoking article of the present invention is provided with preferred requirements, as a filler for a smoking article, of being fluffy, smooth, light in weight, and/or being unlikely to be broken.

The drying step for obtaining the filler for a smoking article of the present invention may also use "tray type drying" in which a gel comprising a gelling agent and a gelation promotor is frozen relatively slowly at a temperature higher than the freezing temperature at the time of freeze drying to obtain a gel solid, and the gel solid is then vacuum-dried.

(6) Tobacco

The filler for a smoking article of the present invention may comprise tobacco. The tobacco contained in the filler for a smoking article is preferably in the form of tobacco fine power or shredded tobacco. These may be added at the time of forming the gel to be contained in the filler for a smoking article.

The amount of tobacco contained in the filler for a smoking article is preferably more than 0% by weight and 35% by weight or less of the filler for a smoking article. The amount of tobacco contained in the filler for a smoking article is more preferably 20% by weight or less of the filler for a smoking article. When the amount of the filler for a smoking article added is larger, the degree of adaptability to compression filling is lowered.

2. Filler B for Smoking Article

The present invention relates to a filler for a smoking article.

The filler for a smoking article of the present invention comprises a gel comprising: pectin having a degree of esterification of 12% or less; and one or more gelation promotors.

"Pectin" and the "gelation promotor" are as described for filler A for a smoking article. Filler B for a smoking article particularly comprises pectin having a degree of esterification of 12% or less as a gelling agent. The use of pectin having a low degree of esterification enables providing a smoking article having lower tobacco odor.

"Having lower tobacco odor" means, for example, that when the odor of a reference sample and the odor of a sample for evaluation are compared, the selection ratio of a sample which is felt to have stronger odor is small, preferably the selection ratio is ½ or less, and more preferably the selection ratio is 1/2.4 or less. The reference sample is, for example, commercially available MEVIUS® SUPER LIGHTS (manufactured by Japan Tobacco Inc.), 3R4F reference cigarette, or the like.

In one embodiment of the filler for a smoking article of the present invention, at least one of the gelation promotors is a compound comprising a divalent cation. In the filler for a smoking article of the present invention, at least one of the gelation promotors is a compound comprising a calcium ion. The "compound comprising a divalent cation" and the "compound comprising a calcium ion" are as described for filler A for a smoking article.

The filler for a smoking article of the present invention may comprise tobacco. The "tobacco" contained in the filler for a smoking article is as described for filler A for a smoking article. The amount of tobacco contained in the filler for a smoking article is preferably more than 0% by weight and 35% by weight or less of the filler for a smoking article.

The gel contained in the filler for a smoking article of the present invention is preferably dried by freeze drying, supercritical drying, or drying under reduced pressure. The "freeze drying", "supercritical drying", "drying under reduced pressure" and "tray type drying" are as described for filler A for a smoking article.

Regarding other things unless otherwise specified, the embodiments of filler B for a smoking article are as described for filler A for a smoking article.

3. Smoking Article

The present invention relates to a smoking article including the filler for a smoking article of the present invention (filler A for a smoking article or filler B for a smoking article).

The type of the "smoking article" is not particularly limited. Both of a combustible type smoking article (such as a cigarette) and a non-combustible type smoking article are included. For example, a cut blend in which the filler for a smoking article of the present invention and shredded tobacco are blended can be applied to a tobacco rod for a cigarette.

The amount of the filler for a smoking article contained in the smoking article is not particularly limited. In one embodiment of the present invention, the smoking article comprises 10% by weight to 30% by weight of the filler for a smoking article of the present invention in a tobacco rod.

4. Method for Manufacturing Filler for Smoking Article

The present invention relates to a method for manufacturing a filler for a smoking article, and specifically relates to a method for manufacturing a filler for a smoking article, the filler comprising a gel comprising: a gelling agent; and one or more gelation promotors.

The manufacturing method of the present invention includes a step of drying a gel comprising a gelling agent and one or more gelation promotors by freeze drying, supercritical drying, or drying under reduced pressure.

The "gelling agent" and the "gelation promotor" are as described for filler A for a smoking article. The gelation promotor is pectin in one embodiment. "Pectin" is as described in filler A for a smoking article and filler B for a smoking article.

The "freeze drying", "supercritical drying", and "drying under reduced pressure" are as described for filler A for a smoking article.

The manufacturing method of the present invention includes a step of mixing a gelling agent and one or more gelation promotors, thereby forming a gel. The step until forming the gel is not particularly limited.

In one embodiment of the manufacturing method of the present invention, the gelling agent and the gelation promotors are dissolved in a solvent, preferably a solvent such as water, to cause gelation. The ratio (solid-to-liquid ratio (%)) of the total amount of the gelling agent and the gelation promotor (compound comprising a divalent cation) to the solvent is preferably, but not limited to, 3% or less.

Tobacco in the form of a tobacco fine powder or shredded tobacco may be added when the gelling agent and one or more gelation promotors are mixed.

A filler for a smoking article manufactured by the manufacturing method of the present invention preferably has characteristics that the tap density is 0.05 g/cm$^3$ or less and the degree of adaptability to compression filling is more than 60. Alternatively, the filler for a smoking article manufactured by the manufacturing method of the present invention has a characteristic that the tobacco odor is lower by using pectin having a low degree of esterification.

EXAMPLES

Hereinafter, the present invention will be described in detail based on Examples, but the present invention is not limited to these Examples. A person skilled in the art can easily modify/change the present invention based on the description of the present specification, and such modifications and changes are included in the technical scope of the present invention.

Example 1: Tap Density and Degree of Adaptability to Compression Filling of Fillers for Smoking Article Using Various Gelling Agents In the present Example, the tap density (after measuring compressed density) and the compressed density were measured for the fillers for a smoking article using various gelling agents. Further, the degree of adaptability to compression filling was calculated based on the tap density after measuring the compressed density and the compressed density.

(1) Manufacture of Filler for Smoking Article

Example 1-1

In 500 g of distilled water, 5.3 g of LM-pectin (manufactured by Herbstreith & Fox GmbH, degree of esterification of 9%) was stirred well using a magnetic stirrer (Magnetic Stirrer IS-36H, IKEDA scientific Co., Ltd.), and the temperature was elevated to 75° C. using a heater so that the solute was dissolved sufficiently to obtain an aqueous solution. The aqueous solution was stirred using a homogenizer (HM-300, HSINGTAI) at about 8000 rpm for 30 seconds. To the aqueous solution, 1.3 g of calcium carbonate (manufactured by FUJIFILM Wako Pure Chemical Corporation) was added, and further, 5 ml of a 10 wt % aqueous citric acid solution (manufactured by FUJIFILM Wako Pure Chemical Corporation) was added to obtain a pectin gel. The pectin gel was transferred into a beaker and rapidly cooled using an ethanol solution cooled to −80° C. to obtain a solid of the gel. The gel solid was transferred into a vacuum drier, and the gel was dried in a low pressure state of 200 pa or less (freeze-dried) to obtain a filler.

After the filler 1 was destroyed, the filler was sieved in such a way as to pass through a 5.6 mm sieve mesh and not to pass through a 1.4 mm sieve mesh to use as a filler for a smoking article of Example 1-1.

Examples 1-2, 1-3, 1-4, and 1-5

Manufacture was performed in the same manner as in Example 1-1, except that LM-pectin in Example 1-1 was changed to gellan gum (manufactured by FUJIFILM Wako Pure Chemical Corporation), Na alginate (manufactured by FUJIFILM Wako Pure Chemical Corporation), gum arabic, and HM-pectin (manufactured by Herbstreith & Fox GmbH) in Examples 1-2, 1-3, 1-4, and 1-5, respectively. Manufactured fillers were used as fillers for a smoking article of Examples 1-2, 1-3, 1-4, and 1-5, respectively.

Comparative Examples 1-1, 1-2, 1-3, and 1-4

Manufacture was performed in the same manner as in Example 1-1, except that LM-pectin in Example 1-1 was changed to starch, CMC, agar, and a combination of HM-pectin and sucrose (only HM-pectin is manufactured by Herbstreith & Fox GmbH, and the others are manufactured by FUJIFILM Wako Pure Chemical Corporation) in Comparative Examples 1-1, 1-2, 1-3, and 1-4, respectively. Manufactured fillers were used as fillers for a smoking article of Comparative Examples 1-1, 1-2, 1-3, and 1-4, respectively.

(2) Measurement of Tap Density and Compressed Density, and Calculation of Degree of Adaptability to Compression Filling Measurement of Tap Density The tap density of the fillers for a smoking article was measured as follows, using "Test methods for bulk density of fine ceramic powder" (JIS 1628-1997) in Japanese Industrial Standards as reference.

A filler for a smoking article, which had been stored for 48 hours under an environment where the room temperature was 22° C. and the humidity was 60%, in a weight of 3.0 g was measured accurately and was placed in a 250 $cm^3$ measuring cylinder using a funnel, subsequently the container was installed on a tap denser set in such a way that the tap height was 10 mm, and the tap speed was 100 times/minute, and 600 times of taps were performed to measure the height to the sample surface. Further, 100 times of taps were added to measure the height to the sample surface. On that occasion, whether the difference from the previously measured height to the sample surface was within 1 mm was checked. When the difference exceeded 1 mm, 100 times of taps at a time were repeated until the difference from the previously measured height fell within 1 mm. The above measurement was performed three times to determine the arithmetical mean as the measurement result ($g/cm^3$).

The tap density was measured after measuring the compressed density.

Measurement of Compressed Density

The compressed density was measured using an expansion property measuring apparatus (Densimeter DD60A, manufactured by Borgwaldt KC GmbH).

A filler for a smoking article, which had been stored for 48 hours under an environment where the room temperature was 22° C. and the humidity was 60%, in a weight of 3.0 g was measured accurately and was placed in a tobacco container having a diameter of 60 mm, and the sample height at the time when a load of 2 kg was applied thereto was read with an expansion property measuring apparatus and was converted to volume to determine the compressed density ($g/cm^3$). The above measurement was performed three times to determine the arithmetical mean as the measurement result ($g/cm^3$).

Degree of Adaptability to Compression Filling

The degree of adaptability to compression filling was defined and calculated as follows.

Degree of adaptability to compression filling=(Compressed density−Tap density after compression measurement)/Compressed density×100

The tap density used for calculating the degree of adaptability to compression filling is the tap density after compression measurement, that is, the tap density of a filling material to which load is applied once.

(3) Results

Figure 3:
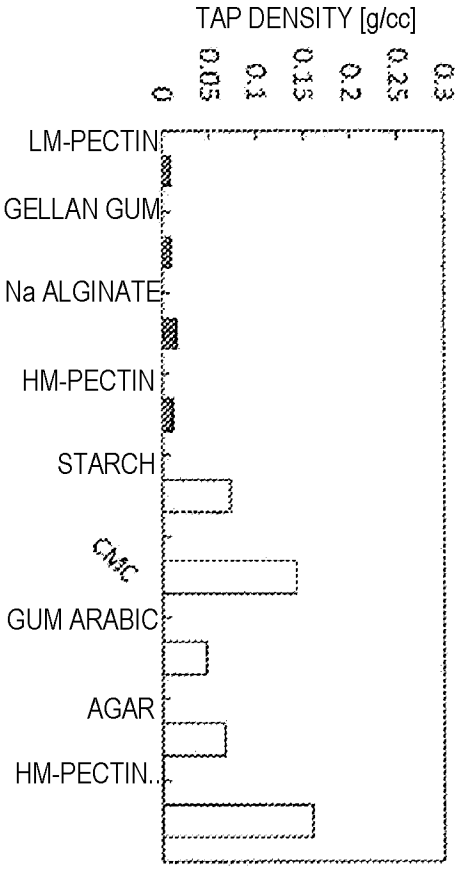
FIG. 3 is a bar graph showing the tap density (after measuring compressed density) in FIG. 1.

The tap density (after measuring compressed density), compressed density, and degree of adaptability to compression filling of respective fillers for a smoking article are shown in FIG. 1. FIG. 2 is a bar graph showing the degree of adaptability to compression filling in FIG. 1. FIG. 3 is a bar graph showing the tap density in FIG. 1. As shown in FIGS. 1 to 3, the degree of adaptability to compression filling and the tap density each show a different value depending on the gelling agent.

When LM-pectin, gellan gum, Na alginate, gum arabic, HM-pectin, and the combination of HM-pectin and sucrose were used, the degree of adaptability to compression filling was more than 60. Particularly in the cases of LM-pectin, gellan gum, and HM-pectin, the degree of adaptability to compression filling was 70 or more.

In the cases of LM-pectin, gellan gum, Na alginate, gum arabic, and HM-pectin in Examples of the present invention, the tap density was 0.05 g/cm$^3$ or less. Particularly in the cases of LM-pectin, gellan gum, Na alginate, and HM-pectin, the tap density was 0.02 g/cm$^3$ or less. The touch of these was fluffy and smooth. In contrast, the fillers of Comparative Examples where starch and agar were used were powdery, and the fillers where CMC, and the combination of pectin and sucrose were used were sticky, and therefore these were unsuitable for use as a filler for a smoking article.

Example 2: Tap Density and Degree of Adaptability to Compression Filling of Fillers for Smoking Article, to which Tobacco Fine Powder was Added In the present Example, the tap density (after measuring compressed density) and the compressed density were measured for fillers for a smoking article, to which a tobacco fine powder was added in various ratios. Further, the degree of adaptability to compression filling was calculated based on the tap density after measuring compressed density, and the compressed density. The measurement of the tap density and the compressed density, and the degree of adaptability to compression filling were measured and calculated in the same manner as in Example 1.

(1) Manufacture of Filler for Smoking Article

Example 2-1

In 500 g of distilled water, 6.5 g of LM-pectin (manufactured by Herbstreith & Fox GmbH, degree of esterification of 9%) was stirred well using a magnetic stirrer (Magnetic Stirrer IS-36H, IKEDA scientific Co., Ltd.), and the temperature was elevated to 75° C. using a heater, so that the solute was dissolved sufficiently to obtain an aqueous solution. The aqueous solution was stirred using a homogenizer (HM-300, HSINGTAI) at about 8000 rpm for 30 seconds. To the aqueous solution, 3.5 g of calcium carbonate (manufactured by FUJIFILM Wako Pure Chemical Corporation) was added, and further, 0.1 g of a tobacco fine powder and 5 ml of a 10 wt % aqueous citric acid solution (manufactured by FUJIFILM Wako Pure Chemical Corporation) were added to obtain a pectin gel. The tobacco fine powder was obtained by using a shredded blend tobacco for use in MEVIUS® SUPER LIGHTS (manufactured by Japan Tobacco Inc.) as a raw material and pulverizing the shredded blend tobacco using a commercially available coffee mill. The pectin gel was transferred into a beaker and rapidly cooled using an ethanol solution cooled to −80° C. to obtain a solid of the gel. The gel solid was transferred into a vacuum drier, and the gel was dried in a low pressure state of 200 pa or less (freeze-dried) to obtain a filler.

After the filler 2 was destroyed, the filler was sieved in such a way as to pass through a 5.6 mm sieve mesh and not to pass through a 1.4 mm sieve mesh to use as a filler for a smoking article of Example 2-1.

Examples 2-2, 2-3, and 2-4

Manufacture was performed in the same manner as in Example 2-1, except that the amount of the tobacco fine powder which was added in Example 2-1 was changed to 1.1 g, 2.5 g, and 5.4 g in Examples 2-2, 2-3, and 2-4, respectively. Manufactured fillers were used as fillers for a smoking article of Examples 2-2, 2-3, and 2-4, respectively.

Comparative Example 2-1

Manufacture was performed in the same manner as in Example 2-1, except that the amount of the tobacco fine powder which was added in Example 2-1 was changed to 10 g. Manufactured filler was used as a filler for a smoking article of Comparative Example 2-1.

(2) Results

The tap density (after measuring compressed density), compressed density, and degree of adaptability to compression filling of respective fillers for a smoking article are shown in FIG. 4. FIG. 5 is a graph with the degree of adaptability to compression filling and the tobacco fine powder content (%) in FIG. 1 as the vertical axis and the horizontal axis, respectively. As shown in FIGS. 4 and 5, when the ratio of the tobacco fine powder contained in the filler for a smoking article increases, the degree of adaptability to compression filling decreases. When the tobacco fine powder content is 35% or less, the degree of adaptability to compression filling was more than 60. When the tobacco fine powder content is 20% or less, the degree of adaptability to compression filling was more than 70. In Comparative Example 2-1 where the tobacco fine powder content is 50%, the degree of adaptability to compression filling was low, as low as 51.9.

Example 3: Tap Density and Degree of Adaptability to Compression Filling of Fillers for Smoking Article by Differences in Drying Method In the present example, differences in the tap density (after measuring compressed density), the compressed density, and the degree of adaptability to compression filling by differences in the drying step in manufacturing a filler for a smoking article were investigated. The measurement of the tap density and the compressed density, and the degree of adaptability to compression filling were measured and calculated in the same manner as in Example 1.

(1) Manufacture of Filler for Smoking Article

Example 1-1

As the filler for a smoking article of the present invention in the present Example, the filler for a smoking article, described in Example 1-1, was adopted. In Example 1-1, the pectin gel was freeze-dried to obtain the filler for a smoking article. Specifically, the obtained pectin gel was transferred into a beaker and rapidly cooled using an ethanol solution cooled to −80° C. to obtain a solid of the gel. The gel solid was transferred into a vacuum drier, and the gel was dried in a low pressure state of 200 pa or less (freeze-dried) to obtain the filler.

Comparative Examples 3-1, 3-2, and 3-3

In Comparative Example 3-1, a pectin gel was obtained in the same manner as in Example 1-1. The obtained pectin gel was dried by hot-air (warm-air) drying, not by freeze drying. Specifically, the pectin gel was spread uniformly in a 20 cm×20 cm square stainless steel vat and left standing for three hours in a warm air drier set at 80° C. to be dried completely. Thus, a filler for a smoking article of Comparative Example 3-1 was obtained.

In Comparative Examples 3-2 and 3-3, manufacture was performed in the same manner as in Comparative Example 3-1, except that pectin was changed to gellan gum (manufactured by FUJIFILM Wako Pure Chemical Corporation) and Na alginate (manufactured by FUJIFILM Wako Pure Chemical Corporation), respectively, and drying was performed by hot-air (warm-air) drying.

(2) Results

The tap density (after measuring compressed density), compressed density, and degree of adaptability to compression filling of respective fillers for a smoking article are shown in FIG. 6 and Example 1-1 in FIG. 1. FIG. 7 is a bar graph showing the degree of adaptability to compression filling in FIG. 6 and of Example 1-1 in FIG. 1.

Example 1-1 (freeze drying) and Comparative Example 3-1 (hot-air drying) have the same compositions of the gelling agent and the gelation promotor. However, when the method of drying the pectin gel was freeze drying (Example 1-1), a fluffy, smooth filler for a smoking article having a degree of adaptability to compression filling of 74.9 and a tap density of 0.01 was obtained, but in contrast, an extremely hard filler having a degree of adaptability to compression filling of 3.0 and a tap density of 0.250 was made in the case of hot-air drying (Comparative Example 3-1).

Similarly, Comparative Examples 3-2 and 3-3 have the same compositions of the gelling agent and the gelation promotor as Example-1-2 and Example 1-3, respectively. However, in the case of hot-air drying (Comparative Examples 3-2 and 3-3), extremely hard fillers having a degree of adaptability to compression filling of −2.8 and −15.7, respectively, and a tap density of 0.263 and 0.255, respectively, were made, which is similar to Comparative Example 3-1.

Example 4: Tap Density and Degree of Adaptability to Compression Filling in the Case where Solid-to-Liquid Ratio in Fillers for Smoking Article was Changed In the present Example, the tap density (after measuring compressed density), compressed density, and degree of adaptability to compression filling in the case where the solid-to-liquid ratio in fillers for a smoking article was changed were investigated. The measurement of the tap density and the compressed density, and the degree of adaptability to compression filling were measured and calculated in the same manner as in Example 1.

(1) Manufacture of Filler for Smoking Article

The amount of LM-pectin and the amount of the gelling agent (calcium carbonate) in Example 1-1 were changed as described in FIG. 8 to make the solid-to-liquid ratio 3.0%, 4.5%, 6.7%, 10.0%, and 12.5% (Example 4-1, Comparative Example 4-1, Comparative Example 4-2, Comparative Example 4-3, and Comparative Example 4-4, respectively). Manufacture of fillers for a smoking article was performed in the same manner as in Example 1 except for those described above.

(2) Results

Figure 9:
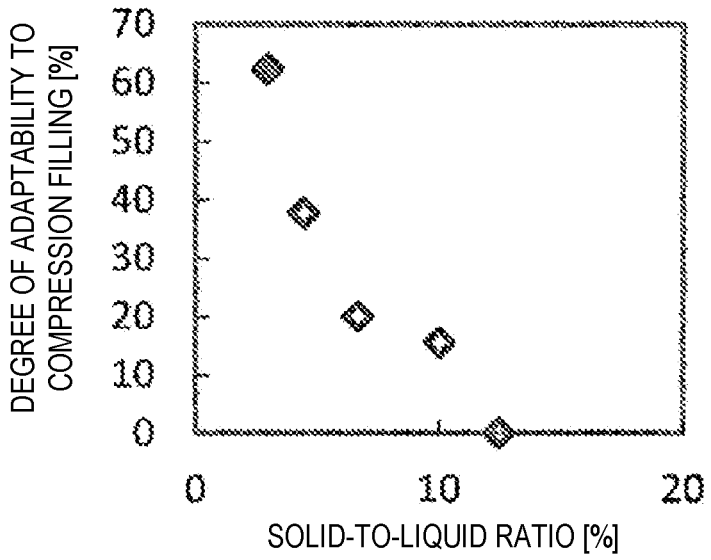
FIG. 9 is a graph with the solid-to-liquid ratio and the degree of adaptability to compression filling in FIG. 8 as the horizontal axis and the vertical axis, respectively.
Figure 10:
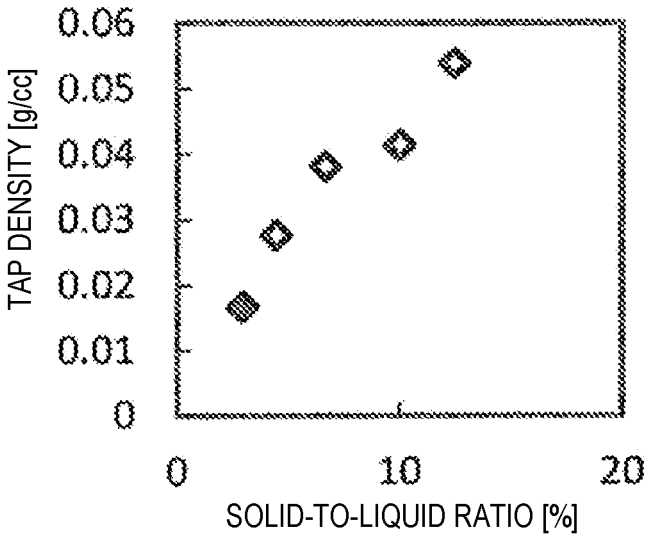
FIG. 10 is a graph with the solid-to-liquid ratio and the tap density in FIG. 8 as the horizontal axis and the vertical axis, respectively.

The tap density (after measuring compressed density), compressed density, and degree of adaptability to compression filling of respective fillers for a smoking article are shown in Example 1-1 in FIG. 1, and FIG. 8. FIG. 9 is a graph with the solid-to-liquid ratio (%) and the degree of adaptability to compression filling in FIG. 8 as the horizontal axis and the vertical axis, respectively. FIG. 10 is a graph with the solid-to-liquid ratio (%) and the tap density in FIG. 8 as the horizontal axis and the vertical axis, respectively.

As can be seen from the results of Example 1-1, and the results of the present Example shown in FIGS. 8 to 10, when the solid-to-liquid ratio of a filler for a smoking article is 3.0% or less, a fluffy filler for a smoking article having a degree of adaptability to compression filling of 62.2 or more was obtained, but when the solid-to-liquid ratio is 4.5 or more, a hard filler having a degree of adaptability to compression filling of 37.7 or less was made. The higher the solid-to-liquid ratio was, the lower the degree of adaptability to compression filling was and the more the tap density increased. Particularly in Comparative Example 4-4 where the solid-to-liquid ratio is 12.5%, an extremely hard filler having a degree of adaptability to compression filling of 0.0 and a tap density of 0.054 was made.

Example 5: Tap Density, Degree of Adaptability to Compression Filling, and Expansion Property in the Case where Mixing Ratio of Gelling Agent to Gelation Promotor in Filler for Smoking Article was Changed In the present Example, the tap density (after measuring compressed density), compressed density, degree of adaptability to compression filling, and expansion property of fillers for a smoking article in the case where the ratio of the gelling agent to the gelation promotor was changed were investigated. The measurement of the tap density and the compressed density, and the degree of adaptability to compression filling were measured and calculated in the same manner as in Example 1.

(1) Manufacture of Filler for Smoking Article

In 500 g of distilled water, LM-pectin (manufactured by Herbstreith & Fox GmbH, degree of esterification of 9%) in an amount in each rod shown in FIG. 11 was stirred well using a magnetic stirrer (Magnetic Stirrer IS-36H, IKEDA scientific Co., Ltd.), and the temperature was elevated to 75° C. using a heater, so that the solute was dissolved sufficiently to obtain an aqueous solution. The aqueous solution was stirred using a homogenizer (HM-300, HSINGTAI) at about 8000 rpm for 30 seconds. To the aqueous solution, calcium carbonate (manufactured by FUJIFILM Wako Pure Chemical Corporation) in an amount in each rod shown in FIG. 11 was added, and further, 5 ml of a 10 wt % aqueous citric acid solution (manufactured by FUJIFILM Wako Pure Chemical Corporation) was added to obtain a pectin gel. The pectin gel was transferred into a beaker and rapidly cooled using an ethanol solution cooled to −80° C. to obtain a solid of the gel. The gel solid was transferred into a vacuum drier, and the gel was dried in a low pressure state of 200 pa or less (freeze-dried) to obtain a filler.

After the filler 1 was destroyed, the filler was sieved in such a way as to pass through a 5.6 mm sieve mesh and not to pass through a 1.4 mm sieve mesh. The resultant was used as a filler for a smoking article.

The measurement of the tap density and the compressed density, and the degree of adaptability to compression filling were measured and calculated in the same manner as in Example 1.

(2) Ratio of Gelling Agent to Gelation Promotor

Regarding the ratio of the gelling agent and the gelation promotor, the point of view of the weight ratio in a preferred embodiment will be described below. As a precondition, pectin used in Example 5 and Comparative Example 5 is assumed to consist of only galacturonic acid and galacturonic acid methyl ester.

(Pectin)

A constituent unit having a carboxyl group (hereinafter, referred to as galacturonic acid) accounts for 192 g/mol, and a constituent unit having a methylcarboxyl group (hereinafter, referred to as galacturonic acid methyl ester) accounts for 206 g/mol. Assuming DE=9%, galacturonic acid and galacturonic acid methyl ester exist in a ratio of galacturonic acid:galacturonic acid methyl ester=0.91 mol:0.09 mol in the pectin straight chain in 1 mol of pectin.

(Calcium Ion)

Calcium carbonate is used in the present Example, therefore $CaCO_3$=100 g/mol.

To obtain a filler for a smoking article by causing gelation to materials efficiently, galacturonic acid and calcium carbonate may be allowed to exist in a ratio of 2 mol:1 mol. When this is converted to a weight ratio, the result is as follows.

Galacturonic acid: 192 g/mol*2 mol=384 g

Calcium carbonate: 100 g/mol*1 mol=100 g

In the case of DE=9%, galacturonic acid in a ratio of 91% and galacturonic acid methyl ester in a ratio of 9% are contained each as a constituent unit in pectin, and therefore when the galacturonic acid methyl ester is added to galacturonic acid to be needed, the total weight of pectin to be needed is as follows.

(206 g/mol*0.09 mol*2 mol/0.91 mol)+384 g=424 g

Accordingly, these are converted to a weight ratio to obtain pectin:calcium carbonate=424 g:100 g=81:19 (mixing ratio (weight ratio) of calcium carbonate is 19.1%). Because of calcium carbonate:calcium=1:0.4, the weight ratio of pectin to calcium ion is pectin:calcium ion=1:0.09.

The mixing ratios (weight ratio) of calcium carbonate used in respective Examples and Comparative Example are as follows.

Example 5-1: 10.6%

Example 1-1: 19.7% (closest to preferred mixing ratio)

Example 5-2: 30.3%

Example 5-3: 50.0%

Example 5-4: 69.7% Comparative Example 5-1: 89.4%

(3) Measurement of Expansion Property

The compressed density was measured using an expansion measuring apparatus (Densimeter DD60A, manufactured by Borgwaldt KC GmbH).

A filler for a smoking article, which had been stored for 48 hours under an environment where the room temperature was 22° C. and the humidity was 60%, in a weight of 3.0 g was measured accurately and was placed in a tobacco container having a diameter of 60 mm, and the sample height at the time when a load of 2 kg was applied thereto was read with an expansion property measuring apparatus (Densimeter DD60A, manufactured by Borgwaldt KC GmbH) and was converted to volume to determine the expansion property ($g/cm^3$). The above measurement was performed three times to determine the arithmetical mean as the measurement result.

(4) Results

Figure 12:
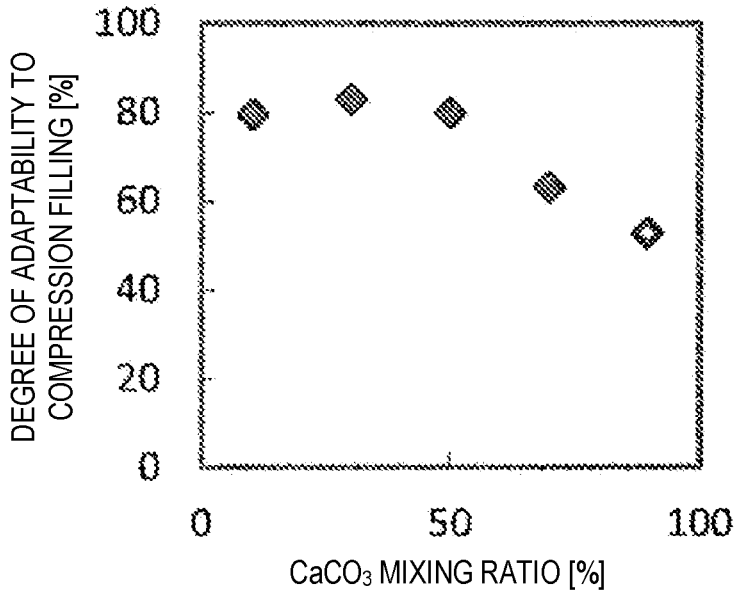
FIG. 12 is a graph with the $CaCO_3$ mixing ratio and the degree of adaptability to compression filling in FIG. 11 as the horizontal axis and the vertical axis, respectively.
Figure 13:
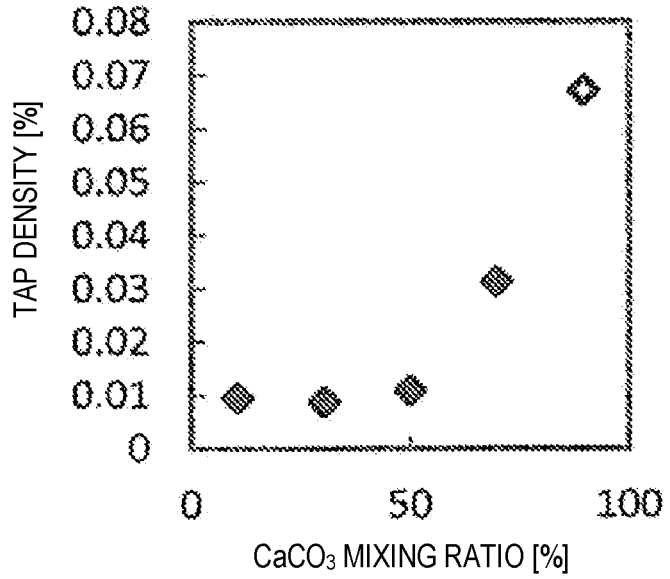
FIG. 13 is a graph with the $CaCO_3$ mixing ratio and the tap density in FIG. 11 as the horizontal axis and the vertical axis, respectively.
Figure 14:
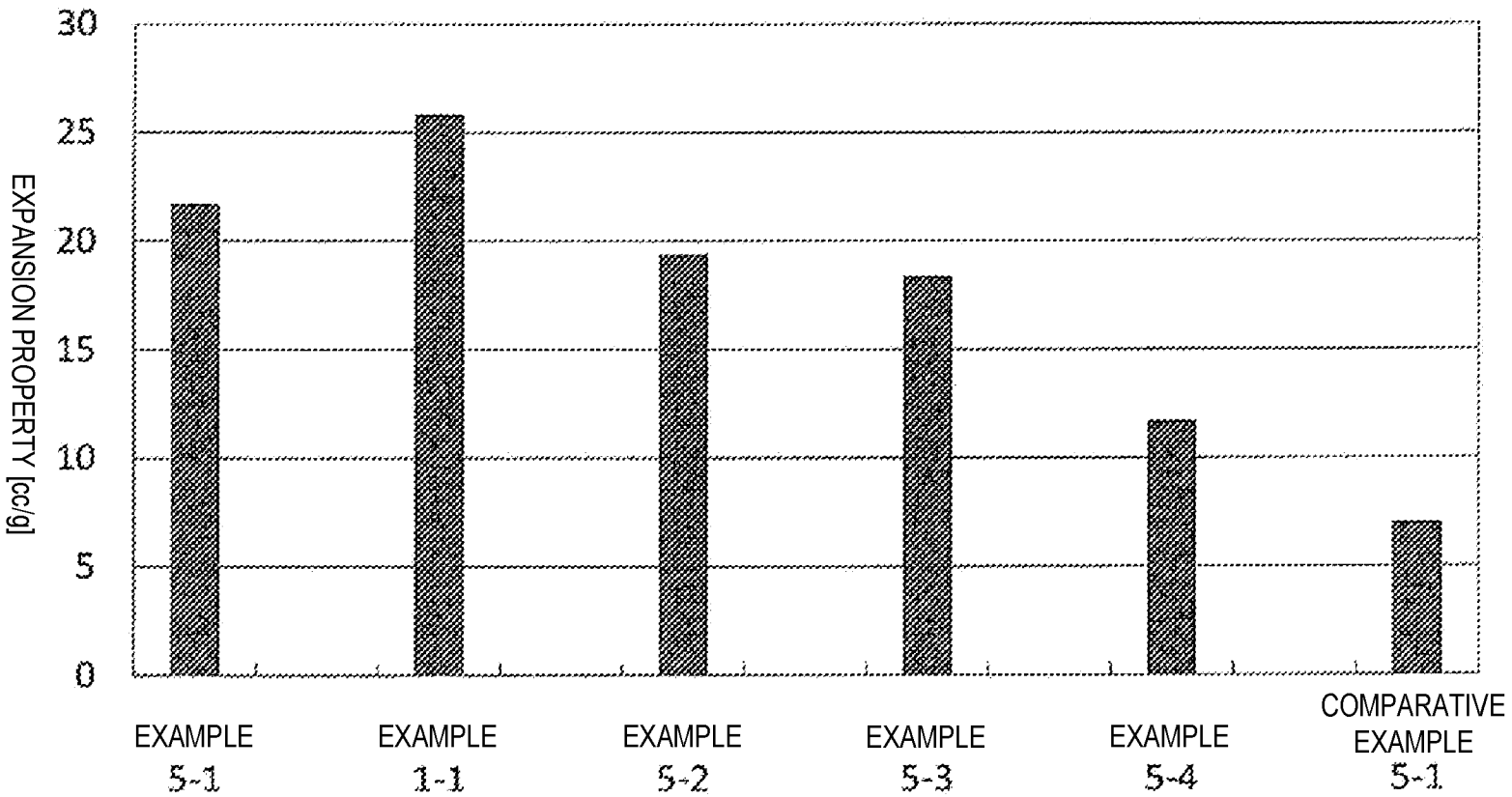
FIG. 14 is a graph obtained by arranging Example 1-1, Examples 5-1 to 5-4, and Comparative Example 5-1 on the horizontal axis in ascending order of the mixing ratio (weight ratio) of calcium carbonate to show the results of the expansion property ($cm^3/g$) as the vertical axis.

The results for the tap density, the compressed density, the degree of adaptability to compression filling, and the expansion property are shown in FIGS. 11 to 14. FIG. 12 and FIG. 13 are graphs with the degree of adaptability to compression filling and the tap density each described in FIG. 11, respectively, as the vertical axis and the mixing ratio (weight ratio) of calcium carbonate, described in FIG. 11, as the horizontal axis. FIG. 14 is a graph obtained by arranging Example 1-1, Examples 5-1 to 5-4, and Comparative Example 5-1 on the horizontal axis in ascending order of the mixing ratio (weight ratio) of calcium carbonate to show the results of the expansion property ($cm^3/g$) as the vertical axis.

The highest expansion property was obtained in Example 1-1 among the fillers for a smoking article, investigated in the present Example. The mixing ratio of calcium carbonate in Example 1-1 (mixing ratio of calcium carbonate of 19.7%) is the closest to the preferred theoretical value (19.1%) estimated in "(2) Ratio of Gelling Agent to Gelation Promotor" described above.

It was ascertained the requirements that the tap density is 0.05 $g/cm^3$ or less and the degree of adaptability to compression filling is more than 60 are satisfied in the range of Example 5-1 to Example 5-4, namely in the range where the ratio of gelling agent:gelation promotor is 1:0.12 to 1:2.3. This corresponds to the case where the molar ratio of the monomer comprising a carboxyl group in pectin to the divalent cation which is a gelation promotor is 1:0.25 to 1:5 (4.9).

The present Example backs up the theory of the present invention that "One calcium ion to two galacturonic acids in pectin forms a crosslinked structure. With respect to ideal pectin formed in such a way that galacturonic acid and galacturonic acid methyl ester are repeated with a degree of esterification of 9%, crosslinks are formed without deficiency and excess when the ratio of pectin:calcium ion is about 1:0.09 on a weight ratio basis, that is, when the ratio of the carboxyl group in pectin to the compound comprising a divalent cation, which is a gelation promotor, is 2:1. From this, a higher expansion property is obtained in a filler for a smoking article, in which a crosslinked structure is formed without deficiency and excess".

Example 6: Tap Density, Degree of Adaptability to Compression Filling, and Expansion Property of Fillers for Smoking Article Obtained by Tray Type Drying In the present Example, the tap density (after measuring compressed density), the compressed density, and the degree of adaptability to compression filling in the case where a tray type drying step was used in manufacturing a filler for a smoking article were investigated. The measurement of the tap density and the compressed density, and the calculation of the degree of adaptability to compression filling and the expansion property were measured and calculated in the same manner as in Example 1.

(1) Manufacture of Filler for Smoking Article

In the present Example, the composition described in Example 1-1 was adopted as the composition of a filler for a smoking article. In Example 1-1, the pectin gel was freeze-dried to obtain the filler for a smoking article. In the present Example, a pectin gel was obtained by the same method as in Example 1-1, and the pectin gel was then preliminarily frozen in a −40° C. freezer for 24 hours to obtain a gel solid. Thereafter, the gel solid was dried with a vacuum drier to obtain a filler (tray type drying) (Example 6-1).

(2) Results

The results for the tap density, the compressed density, the degree of adaptability to compression filling, and the expansion property are shown in FIG. 15. From FIG. 15, a filler for a smoking article that satisfies the requirements of the present invention that the tap density is 0.05 g/cm$^3$ or less and the degree of adaptability to compression filling is more than 60 was obtained in the case where the tray type drying step was used as well as the case where the freeze-drying step was used in Example 1-1.

Example 7: Organoleptic Evaluation of Side Stream Smoke Odor of Cigarettes Including Fillers for Smoking Article, Using Various Types of Pectin Having Various Degrees of Esterification as Gelling Agents In the present Example, organoleptic evaluation of the side stream smoke odor of cigarettes including fillers for a smoking article using various types of pectin each having a different degree of esterification as gelling agents was performed.

(1) Manufacture of Cigarette

Example 7-1

A cut blend was obtained by blending 50 mg of the filler for a smoking article of Example 1-1 and 285 mg of shredded tobacco used in MEVIUS® SUPER LIGHTS (manufactured by Japan Tobacco Inc.). A tobacco rod part having a length of 59 mm and a circumference of 25 mm was prepared by wrapping the cut blend with a wrapper for MEVIUS® SUPER LIGHTS (manufactured by Japan Tobacco Inc.), which is used for a commercially available tobacco rod part, using a roll-up manufacturing machine RIZRA ("RIZRA/ROLLER"). The tobacco rod part and a filter rod part, which is used for a commercially available cigarette, were connected using a general filter wrapper to obtain a cigarette of Example 7-1.

Example 7-2

Manufacture was performed in the same manner as in Example 7-1, except that LM-pectin, which was used for the filler for a smoking article in Example 7-1, was changed from pectin having a degree of esterification=9% to pectin having a degree of esterification=12%. The manufactured cigarette was used a cigarette of Example 7-2.

Comparative Examples 7-1, 7-2, 7-3, and 7-4

Manufacture was performed in the same manner as in Example 7-1, except that LM-pectin, which was used for the filler for a smoking article in Example 7-1, was changed from pectin having a degree of esterification=9% to pectin having a degree of esterification=23%, 38%, 58%, and 65% in Comparative Examples 7-1, 7-2, 7-3, and 7-4, respectively. The manufactured cigarettes were used as cigarettes of Comparative Examples 7-1, 7-2, 7-3, and 7-4, respectively.

Comparative Examples 7-5 and 7-6

Manufacture was performed in the same manner as in Example 7-1, except that the filler for a smoking article in Example 7-1 was changed from Example 1-1 (gelling agent: LM pectin (degree of esterification=9%) to Example 1-2 (gelling agent:gellan gum) and Example 1-3 (gelling agent: sodium alginate) in Comparative Examples 7-5 and 7-6, respectively. The manufactured cigarettes were used as cigarettes of Comparative Examples 7-5 and 7-6, respectively.

(2) Organoleptic Evaluation of Side Stream Smoke Odor

The organoleptic evaluation of the side stream smoke odor was performed for the cigarettes obtained in Examples 7-1 and 7-2, and Comparative Examples 7-1, 7-2, 7-3, 7-4, 7-5, and 7-6 was performed.

The organoleptic evaluation of the side stream smoke odor was carried out using a room method to investigate high-odor cigarette selectivity. In the room method, two rooms (assumed to be room A and room B) (floor area: 31 m$^2$; volume: 85 m$^3$) each of which was tightly closed except for one door through which a person goes in and out were prepared. Five control cigarettes were combusted spontaneously in room A with the door closed. On the other hand, five cigarettes as objects of evaluation were combusted spontaneously in room B with the door closed. Thirty panels were divided into two groups, and all the members of the one group firstly entered room A at the same time, got out of room A, and then entered room B to report results on "which room has stronger tobacco odor" after getting out of room B. All the members of the other group firstly entered room B at the same time, got out of room B, and then entered room A to report results on "which room has stronger tobacco odor" after getting out of room A. The room method described in Japanese Patent No. 3708815 was used as reference.

The high-odor cigarette selectivity is shown as a selection ratio of a sample which is felt to have stronger odor when the odor of commercially available MEVIUS® SUPER LIGHTS (manufactured by Japan Tobacco Inc.) which is a reference sample and the odor of a sample for evaluation are compared.

(3) Results

Figure 17:
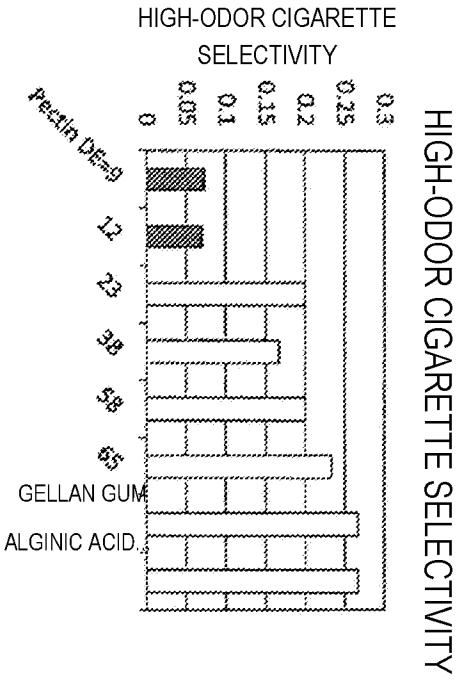
FIG. 17 is a bar graph showing the high-odor cigarette selectivity in FIG. 16.

The results of investigating the high-odor cigarette selectivity for respective cigarettes are shown in FIG. 16 and FIG. 17. FIG. 17 is a bar graph showing the high-odor cigarette selectivity in FIG. 16. As shown in FIG. 16 and FIG. 17, when a filler for a smoking article comprising LM-pectin having a low degree of esterification (12% or less) as a gelling agent was used, the high-odor cigarette selectivity was low, as low as 0.07. When LM-pectin having a higher degree of esterification was used, the high-odor cigarette selectivity was high, as high as 0.17 or more. In addition, in the case where a gelling agent other than LM-pectin was used as well as the case where LM-pectin having a higher degree of esterification was used, the high-odor cigarette selectivity was high.

Accordingly, to manufacture a cigarette having weaker tobacco odor, it is preferable to use pectin having a low degree of esterification (12% or less) as a gelling agent in a filler for a smoking article.

The invention claimed is:

1. A filler for a smoking article, comprising a gel comprising: a gelling agent; and one or more gelation promotors, wherein the filler for a smoking article has a tap density of 0.05 g/cm$^3$ or less and a degree of adaptability to compression filling of more than 60.

2. The filler for a smoking article according to claim 1, wherein the gelling agent is a polysaccharide having a carboxyl group.

3. The filler for a smoking article according to claim 2, wherein the gelling agent is selected from the group consisting of: pectin; gellan gum or sodium alginate; gum arabic; and xanthan gum or gum tragacanth.

4. The filler for a smoking article according to claim 2, wherein at least one of the gelation promotors is a compound comprising a divalent cation.

5. The filler for a smoking article according to claim 1, wherein the gelling agent is selected from the group consisting of: pectin, gellan gum, sodium alginate, gum Arabic, xanthan gum and gum tragacanth.

6. The filler for a smoking article according to claim 5, wherein at least one of the gelation promotors is a compound comprising a divalent cation.

7. The filler for a smoking article according to claim 1, wherein at least one of the gelation promotors is a compound comprising a divalent cation.

8. The filler for a smoking article according to claim 1, wherein at least one of the gelation promotors is a compound comprising a calcium ion.

9. The filler for a smoking article according claim 1, wherein the gel is dried by freeze drying, supercritical drying, or drying under reduced pressure.

10. The filler for a smoking article according to claim 1, wherein the gelling agent is pectin having a degree of esterification of 12% or less.

11. The filler for a smoking article according to claim 1, further comprising more than 0% by weight and 35% by weight or less of tobacco.

12. The filler for a smoking article according to claim 1, wherein the gelling agent is a polysaccharide having a carboxyl group, at least one of the gelation promotors is a compound comprising a divalent cation, and a molar ratio of a monomer comprising a carboxyl group in the polysaccharide to the compound comprising the cation is in a range of 20:1 to 1:10.

13. A smoking article comprising the filler for a smoking article according to claim 1.

14. The smoking article according to claim 13, wherein the filler comprises 10% by weight to 30% by weight of the smoking article.

15. A filler for a smoking article comprising a gel comprising: pectin having a degree of esterification of 12% or less; and one or more gelation promotors.

16. The filler for a smoking article according to claim 15, wherein at least one of the gelation promotors is a compound comprising a divalent cation.

17. The filler for a smoking article according to claim 15, wherein at least one of the gelation promotors is a compound comprising a calcium ion.

18. The filler for a smoking article according to claim 15, further comprising more than 0% by weight and 35% by weight or less of tobacco.

19. A method for manufacturing a filler for a smoking article, the filler comprising a gel comprising: a gelling agent; and one or more gelation promotors, the method comprising a step of drying the gel comprising: a gelling agent; and one or more gelation promotors by freeze drying, supercritical drying, or drying under reduced pressure, wherein the filler for a smoking article has a tap density of 0.05 g/cm$^3$ or less and a degree of adaptability to compression filling of more than 60.

20. The method according to claim 19, further comprising a gelation step of dissolving the gelling agent and the gelation promotors in a solvent, wherein at least one of the gelation promotors is a compound comprising a divalent cation, and a ratio of the gelling agent and the compound comprising a divalent cation to the solvent is 3% or less.

* * * * *